United States Patent [19]

Vernois et al.

[11] Patent Number: 4,680,219

[45] Date of Patent: Jul. 14, 1987

[54] MOLDABLE FIBROUS SHEET AND A METHOD FOR MANUFACTURING SAME

[75] Inventors: Michel Vernois, Courbevois; Francois Paugam, Casteljaloux, both of France

[73] Assignee: Isoroy, Lisieux, France

[21] Appl. No.: 713,744

[22] Filed: Mar. 19, 1985

[30] Foreign Application Priority Data

Mar. 20, 1984 [FR] France ..... 84 04308

[51] Int. Cl.[4] ..... D03D 13/00

[52] U.S. Cl. ..... 428/222; 112/440; 428/221; 428/283; 428/284; 428/288; 428/297; 428/298; 428/340; 428/402

[58] Field of Search ..... 428/288, 287, 296, 326, 428/221, 222, 280, 281, 282, 283, 284, 402, 298, 297; 112/440, 441

[56] References Cited

U.S. PATENT DOCUMENTS 4,331,495 5/1982 Lackman et al. ..... 112/440

4,474,846 10/1984 Doerer et al. ..... 428/288

*Primary Examiner*—James J. Bell

*Attorney, Agent, or Firm*—Browdy and Neimark

[57] ABSTRACT

A moldable fibrous sheet having a cellulose fiber and textile fiber base, said sheet having a composition comprising from 5 to 95% by weight of cellulose fibers obtained by dry shredding, from about 0.5 to 10% of textile fibers having at least two half-waves per centimeter of length, said sheet being further formed by superimposing fine sheets sewn but not rigidly connected to each other. The sheet may be molded into shaped panels through a molding cycle between 15 seconds and 3 minutes, which panels may be used in automobile construction, furnishing and packing.

8 Claims, No Drawings

MOLDABLE FIBROUS SHEET AND A METHOD FOR MANUFACTURING SAME

The present invention relates to a cellulose fiber based moldable fibrous sheet, as well as a method for manufacturing same, said fibrous sheet being used for obtaining shaped work-pieces having applications in numerous fields.

Moldable and/or deformable materials are already known having a wood fiber or wood flour base, the purpose of a vegetable cellulose compound in the composition of these materials being either to lower the cost or to confer thereon certain mechanical characteristics, or else to combine these two elements. These known materials may be classified in three categories, namely, those comprising solely cellulose fibers, those comprising a cellulose powder associated with a thermoplastic material or else those comprising natural fibers and synthetic fibers.

1—In the first category, a mixture in the form of a wet paste is formed from cellulose fibers including a small percentage of phenol resin. The use of this material is relatively complicated to the extent that it requires drying of the mixture in a preform and shaping in a hot mold where final drying and densification of the product is obtained at a pressure of the order of 40 to 50 kg/cm$^2$. The result is a fairly long shaping time prejudicial to a high yield, as well as costly tooling. Moreover, the pieces cannot be dressed simultaneously with the molding operation.

2—In the first category also, a resinous wood fiber sheet comprises a phenol resin as well as colophane. Use thereof requires vapor damping of the sheet, preforming on a cold mold followed by hot shaping at a temperature higher than 180° C. while exerting a pressure of about 50 kg/cm$^2$. This material, although it confers on the finished product good mechanical characteristics and can be coated or painted, on the other hand requires very expensive shaping tools. It does not allow considerable deformation to be obtained without charging the critical zones with resins and cannot receive a covering coat during molding. Moreover, its shaping cycle is relatively long, of the order of 2 minutes. Moreover, the absence of porosity of the material in the zones highly charged with resin requires a microperforation operation before fitting of the covering coat.

3—In the second category, panels are obtained by extrusion of a polypropylene based mixture and a charge of wood flour. Use of these panels requires preheating between 180° and 200° C. using infrared radiation followed by shaping in a cold mold for a minute at a pressure of 5 to 15 kg/cm$^2$. This material, although requiring for its formation only a low pressure and a short cycle, however leads to a final product which is brittle because of the absence of any fibre structure.

4—In the third category, a thermoformable cardboard with a cellulose fiber and polyethylene fiber base is obtained by paper manufacturing methods. Its main disadvantage is due to the fact that this cardboard can only be obtained in weights between 350 and 700 g/m$^2$, which requires several sheets to be stacked so as to obtain the final thickness and weight required generally between 2 and 3 kg/m$^2$.

Preheating of the whole of these sheets is provided between heating plates (170° to 200° C.) so as to obtain fusion of the polyethylene. Molding is obtained at a pressure of 25 to 50 kg/cm$^2$ in a mold heated to a temperature of 80° C.

All the cellulose fiber based moldable materials which are at present available and which have been described in the prior art use a method of the paper manufacturing type, so in a wet medium (cf 4 above), or a process known in the plastic material transformation industry as extrusion (cf. 3 above), or else a dry process of the "Rando Wood" type for forming a fibrous sheet from wood fibers having low residual humidity carried by air to a modified "Rando" device. In this latter case, a fibrous sheet is obtained directly having the final desired thickness.

The present invention overcomes the above disadvantages of materials by providing a moldable fibrous sheet, easy to use with a view to the molding operations, having an excellent natural disposition to considerable deformation without tearing and thus leading to shaped pieces difficult to obtain with known materials.

According to the invention, the sheet has an overall composition comprising more especially from 5 to 95% by weight of cellulose fibers provided by dry shredding and about 0.5 to 10% of synthetic or natural textile fibers having at least two half-waves per centimeter, said sheet being formed from superimposing fine layers quilted but not connected rigidly together.

In a first embodiment, the sheet comprises about 5 to 80% by weight of said cellulose fibers, from about 0.5 to 10% of said textile fibers and, in addition from about 5 to 60% by weight of a thermoplastic material.

In a second embodiment, the sheet comprises up to 95% by weight of said cellulose fibers and from about 0.5 to 10% of said textile fSibers, the cellulose fibers being previously coated with a resin, for example a phenol resin.

For manufacturing a sheet of the above type, the constituent elements are mixed together, the mixture thus obtained is carded, a fine layer is formed of a weight between 10 and 200 g/m$^2$, successively folds of said sheet are superimposed and fixed together so as to form the sheet whose weight is adjusted to the desired value, up to about 2 kg/m$^2$.

In the particular case of the second embodiment, such as defined above, the cellulose fibers are coated with glue before being mixed with the textile fibers.

Other features and advantages of the present invention will be clear from the following description, given by way of non limitative example.

The cellulose fibers are advantageously of the type obtained by thermomechanical means from wood and have low residual humidity, less than 15%, which in no wise excludes the possibility of using cellulose fibers obtained by any other shredding technique associated with possible refining using different known processes in the paper manufacturing field or in the fiber panel sector. These fibers may, if required, have received a treatment conferring thereon certain properties required depending on the application contemplated. By way of non limitative example, a wax or a paraffin may be incorporated so as to obtain a final waterproof product.

The textile fibers having several half-waves per centimeter must have a length such that, during forming of the sheet by carding, layering and quilting techniques, they confer a certain mechanical strength on the sheet so as to make it transportable without any other form of consolidation.

Furthermore, these fibers will confer a certain deformability on the material without any tearing phenomenon appearing within the mattress. By way of non limitative example, polypropylene fibers and polyester fibers having an average length of 38 mm and comprising three to five half-waves per centimeter have proved to be perfectly suitable.

I—in the case of the first embodiment mentioned above, the thermoplastic material forms an integral part of the sheet either in the form of fibrils or fibers, or in the form of powder.

In the case of fibrils or fibers, the component material is thermoplastic and has a softening point less than 200° C. By way of non limitative example, polyethylene or polypropylene fibers may be mentioned.

These thermoplastic fibers, after melting or softening during the subsequent preheating operation, will confer better cohesion on the molded product, better mechanical characteristics as well as a certain hydrophobic property on the shaped panel.

More over, flowing in the mold of the thermoplastic material heated beyond its softening point improves the molding capability.

It is also possible to use, instead of the thermoplastic fibers, a thermoplastic polymer in the form of a powder or granules of small diameter. This polymer will also have a softening point less than 200° C.

For the operation for mixing the components of the sheet, two cases arise:

(a) the thermoplastic material is in the form of fibers or fibrils:

The three components in adequate proportions are mixed in a rotary machine, formed possible by a sizing machine. In general, the thermoplastic fibers or fibrils delivered in bulky form will have to be previously separated in a device of the opening type such as those used in the textile industry. The same will go for textile fibers of a length between 10 and 60 mm which will have to receive a pretreatment of the same kind.

(b) the thermoplastic material is in the form of a powder or granules of small diameter:

Only the wood fibers and the textile fibers are in this case mixed in the desired proportions in the rotary machine. The thermoplastic material is incorporated subsequently in the form of powder or small diameter granules during forming of the sheet using an appropriate device, for example, during the layering stage. In this case, the sheet may be considered as being formed in an inhomogeneous way but more precisely from a succession of alternate layers of small thickness.

For forming the sheet apparatus of the textile type are used associating a loader, a carding device, a layering machine and a quilting machine. The carding machine should be provided with a carding brush adapted for treating the above described fibrous mixture so that there is neither packing in the machine nor segregation between the long fibers and the short fibers or at least the least segregation possible.

If need be, the carding machine will be provided with a cover casing for forcing the fibers to pass into the carding cylinder or cylinders as well as a device for recovering the short fibers which will be fed back to the head of the machine in the loading unit.

On leaving the carding unit, the fibrous mixture comprising the wood fibers, the thermoplastic material and the textile fibers of large length is in the form of a layer of low weight (10 to 200 g/m$^2$) which is held in place by an appropriate device of the double canvas type as far as the layering machine.

This layering machine allows a high weight sheet to be formed (about 2 kg/m$^2$) by successive stacking of layers. The weight of the mattress to the square meter may be easily modified by varying for example the relative speed between the feed belt and the belt at the outlet of the layering machine. The number of outward and inward journeys of the mobile device of the layering machine gives the number of successive layers stacked in a given time and allows the weight of the sheet to be adjusted over a large range. Similarly, the sheet may be obtained in variable widths by simply adjusting the movement of the reciprocal device of the layering machine. The maximum width will depend solely on the length of the guide on which the layering element moves. An appropriate device associated with the layering machine will, if required, allow the thermoplastic material to be poured in the form of a powder or small diameter granules so as to form a laminated material.

This thermoplastic material may also be inserted, either during each stacking of layers coming from the carding machine, or else after a given number of stacked layers.

The low density mat is then conveyed to a transport belt placed perpendicularly to the carding-layering axis, as far as a quilting machine or possibly a pre quilting machine which will give the final sheet its self supporting capability. At this stage, the sheet has the consistence of a carpet and may be rolled on itself. It is in this form of rolls or reels that it may be handled in view of the transformation or molding operation, without however excluding presentation in the format required, using an appropriate cutting device.

The needle density of the quilting machine allows the thickness of the sheet which it is desired to obtain as well as its mechanical strength to be varied to a certain extent. Thus, slack quilting will lead to a sheet which is not very dense but which is very compressible, whereas tighter quilting will form a thinner sheet.

However, in all cases, this quilting operation while conferring sufficient mechanical strength on the sheet so that it may be easily handled, will allow the mat to keep an excellent deformability in all directions resulting in good molding capability, this resulting in particular from the possible relation of the fine layers with respect to each other.

It is possible to adjoin at the time of quilting to the surface of the mat a surface material which may either participate in the decoration of the finished piece after molding, or facilitate thermobonding of the decorative material. By way of non limitative example, the sheet leaving the layering machine may be sewn simultaneously with a synthetic layer of the non woven type made from polyethylene, polypropylene or any other thermoplastic material with a softening point less than 200° C. which, once heated, will provide better resistance of the decorative material by thermofusion or thermobonding of this non woven material.

It is indispensable for the surface material, whether it is provided for decorative purposes or included for facilitating fixing of another support to the finished panel, to be itself highly extendable in all directions so as not to interfer unfavorably with the molding capability of the fibrous sheet.

In the case where the mat contains one or more thermoplastic components, the operation for molding or forming the sheet is preceded by a step for preheating the sheet, preferably just before pressing. It cannot however be excluded that an appropriate device fixed to the layers could very rapidly provide this preheating of the sheet.

The purpose of preheating is to bring the thermoplastic material or materials present in the sheet to a temperature above their softening point.

These thermoplastic materials will thus flow during pressure molding and participate, after cooling, in consolidation of the shaped panel while conferring thereon certain desired physical properties, water repellency for example. In practice, the preheating temperature is between 100° and 200° C.

By way of non limitative example, preheating could use heating devices by contact, by hot air flowing therethrough and by high frequency.

The apparatus which seems the most appropriate for providing good homogeneity of baking of the fibrous sheet and a short heating time compatible with the molding cycles, is a high frequency heating device associated possibly with heating by contact of the plates of the apparatus.

After preheating, the sheet is immediately transferred to the press for molding. If require, a decorative material forming a surface "skin" is inserted between the sheet at the appropriate temperature and the mold. Molding may be carried out with a cold mold, or a slightly heated mold. In some cases, in fact, a mold heated to a temperature between 60° and a 100° C. confers a better surface condition on the finished piece.

The molding cycle is between 15 seconds and three minutes and the pressure exerted between 20 and 100 kg/cm$^2$. On leaving the press, the material without decorative covering has the appearance of a shaped fibrous panel, having a density between 0.7 and 1.1.

The above moldable sheet allows highly deformed pieces to be obtained, free of tears or material gaps following stretching. The shaped pieces thus obtained remain sufficiently porous for subsequent covering by suction through the component panel.

The non limitative example below will better illustrate the manufacture and treatment of a sheet according to the first embodiment of the invention.

EXAMPLE

Basic mixture:

- poplar or aspen fibers 60%
- voluminized polyethylene fibers 35%
- wavy polypropylene textile fibers 1.5 inch in length (38.1 mm) and of 3 deniers 5%

These three components are mixed in a sizing machine with rotating fingers adjusted to an appropriate rotational speed. Then the mixture is fed into a loading machine which feeds a carding machine in a line with a layering machine.

On leaving the layering machine, the sheet with a weight between 700 and 2500 g/m$^2$ is quilted so as to form a roll.

If necessary, it is possible to carry out pre-sewing on a sheet of 800 g/m$^2$ followed by final sewing on a stack of three identical sheets so as to form a "mat" of a weight to the square meter of 2.4 kg.

Then, the "mat" is preheated using a dielectric loss high frequency heating device whose power is between 30 and 50 kw/h and comprises two heating plates kept at a temperature close to 140° C.

The sheet portion of about a square meter is then heated homogeneously, not only in the core but also at the surface, to a temperature of 170° C. for 30 seconds to 1 minute depending on the power delivered by the high frequency generator (frequency 27.12 MHz).

This preheating device is situated in the immediate vicinity of the press so as to have a minimum of heat loss during transfer of the sheet between the preheating station and the press. If required, this transfer may take place in a lagged tunnel opening on to the plates of the press.

Molding requires between 20 seconds and 2 minutes depending on the type of workpiece required, in a cold mold or at 80° C. at most. In general, a cycle of the order of 45 seconds to one minute allows workpieces to be obtained having the desired deformation and with adequate densification of the material.

A pressure between 40 and 60 kg/cm$^2$ is exerted on the sheet so as to obtain the required properties. Heating of the mold to a temperature of 80° C. leads to a better surface condition of the finished workpiece without having a fibrous appearance. The surface is then slightly glazed.

After cooling, the shaped material remains sufficiently porous to the air so as not to require any other operation of the microperforation type.

II - in the case of the second embodiment mentioned above, the cellulose fibers and the textile fibers have respectively the same characteristics, but the cellulose fiber content may reach 95% by weight whereas the thermoplastic material content is zero.

During manufacture of the sheet, the cellulose fibers are coated with a thermosetting resin before being mixed with the textile fibers, the rest of the operations being identical.

In so far as molding of the mat is concerned in this second embodiment, the preheating operation is eliminated since no thermoplastic material is to be heated to its melting point, whereas a vapor treatment is provided just before molding or during molding in a way known per se, the molding being carried out in a hot mold at a temperature sufficient for curing of the coating resin, for example at a temperature greater than 200° C. for a phenol resin. The molding cycle and conditions are identical for both embodiments described above.

With the sheet of the invention, work pieces may be molded such as shaped panels for the inner lining of motor car doors comprising an integrated arm rest, which requires very high deformation. No tear was observed, even on the highly stretched parts.

Tests have shown moreover that it is possible at the forming stage (pressing) to introduce if required a lining material (carpet, PVC) which remains thermobonded to the shaped panel.

The cutting out and introduction of inserts may also take place during the same cycle, resulting in facility of use and improved productivity.

It should be noted that during the layering operation a water vapor generating compound may be added to the material during the molding stage, such as iron alun for example, if the cellulose fiber content is high and the humidity thereof less than 15%.

Furthermore, in so far as the lining materials are concerned, it is also possible to insert one or more layers having particular properties during the layering operation.

As mentioned above, the sheet of the invention may find various applications using shaped panels, such as in the following fields:

in automobile construction as inner linings for vehicles: inner linings for doors, dashboards, middle rests, rear shelves, different cladding, seat back foundations, louver boards, etc;

furnishing;

travelling articles: suitcases, trunks, etc packing, packaging;

fittings: letter boxes for example:

different covers or casings for office use.

The present invention has of course been described purely by way of non limitative example and any useful modifications may be made thereto, particularly within the field of technical equivalences, without departing from its scope and spirit.

We claim:

1. A moldable fibrous sheet formed by superimposing fine layers, said sheet having a cellulose fiber and textile fiber base, and having a composition comprising from 5 to 95% by weight of cellulose fibers obtained by dry shredding, from about 0.5 to 10% of undulated textile fibers having at least two half-waves of undulation per centimeter of length said undulated fibers by virtue of their undulation of at least two half-waves per container of length being mechanically bonded to other fibers in the sheet, said fine layers being sewn but not rigidly connected to each other.

2. The fibrous sheet according to claim 1, in which said cellulose fibers are of wood obtained by thermomechanical means and have a residual humidity less than 15%.

3. The fibrous sheet according to claim 1, in which said undulated textile fibers have a length of at least 30 mm, with at least two half waves of undulation per centimeter and are formed from a material such as polypropylene and polyester.

4. The fibrous sheet according to claim 1, comprising from 5 to 80% by weight of cellulose fibers, from 0.5 to 10% by weight of said undulated textile fibers, and, in addition, from 5 to 60% by weight of a thermoplastic material selected from the group consisting of fibrils, fibers which are shorter than said textile fibers, and a powder of a material having a softening point less than 200° C., such as polyethylene and polypropylene.

5. The fibrous sheet according to claim 1, including up to 95% by weight of said cellulose fibers and from 0.5 to 10% by weight of said textile fibers.

6. The fibrous sheet according to claim 1, in which said fine layers have each a weight of 10 to 200 g/m$^2$, for a weight of said sheet of about 2 kg/m$^2$.

7. A method for manufacturing a fibrous sheet comprising from 5 to 95% by weight of cellulose fibers obtained by dry shredding, from about 0.5 to 10% of opened textile fibers having at least two half-waves per centimeter of length, wherein the cellulose fibers are coated with a thermosetting resin, the thus coated fibers and said opened textile fibers are mixed together, the mixture thus obtained is carded in the form of one fine layer having a weight of 10 to 200 g/m$^2$, said fine layer is folded up and the successive folds of said layer are superimposed on each other so as to form said sheet whose weight is adjusted to the desired value up to about 2 kg/m$^2$, then said folds are sewn to each other.

8. A method for manufacturing a fibrous sheet comprising from 5 to 80% by weight of cellulose fibers, from 0.5 to 10% of opened textile fibers and from 5 to 60% by weight of a thermoplastic material which is selected from the group consisting of fibrils, fibers which are shorter than said textile fibers, and a powder of a material having a softening point less than 200° C., wherein the cellulose fibers, said opened textile fibers and the thermosplastic material are mixed together, the mixture thus obtained is carded into the form of a fine layer having a weight of 10 to 200 g/m$^2$, then successive folds of said layer are superimposed on each other so as to form the sheet, and the weight of the sheet is adjusted to the desired value up to about 2 kg/m$^2$, then said sheet is sewn.

* * * * *

UNITED STATES PATENT AND TRADEMARK OFFICE

CERTIFICATE OF CORRECTION

PATENT NO. : 4,680,219

DATED : July 14, 1987

INVENTOR(S) : VERNOIS et a;

It is certified that error appears in the above—identified patent and that said Letters Patent is hereby corrected as shown below:

Column 7, line 26: change "container" to read --centimeter--

Signed and Sealed this

Ninth Day of August, 1988

*Attest:*

DONALD J. QUIGG

*Attesting Officer*

*Commissioner of Patents and Trademarks*